US011390108B2

(12) United States Patent
Bez

(10) Patent No.: US 11,390,108 B2
(45) Date of Patent: Jul. 19, 2022

(54) REFILL FOR A WRITING FELT PEN

(71) Applicant: SOCIETE BIC, Clichy (FR)

(72) Inventor: Arnaud Bez, Clichy (FR)

(73) Assignee: SOCIETE BIC, Clichy (FR)

( * ) Notice: Subject to any disclaimer, the term of this patent is extended or adjusted under 35 U.S.C. 154(b) by 0 days.

(21) Appl. No.: 16/938,216

(22) Filed: Jul. 24, 2020

(65) Prior Publication Data

US 2021/0031556 A1 Feb. 4, 2021

(30) Foreign Application Priority Data

Jul. 29, 2019 (EP) ..... 19305982

(51) Int. Cl.

| | |
|---|---|
| ***B43K 8/03*** | (2006.01) |
| ***B43K 8/12*** | (2006.01) |
| ***B43K 5/04*** | (2006.01) |
| ***B43K 8/02*** | (2006.01) |

(52) U.S. Cl.

CPC ..... *B43K 8/12* (2013.01); *B43K 5/04* (2013.01); *B43K 8/022* (2013.01); *B43K 8/024* (2013.01); *B43K 8/03* (2013.01)

(58) Field of Classification Search

CPC . B43K 1/006; B43K 1/12; B43K 5/03; B43K 8/02; B43K 8/022; B43K 8/024; B43K 8/026; B43K 8/028; B43K 8/03

See application file for complete search history.

(56) References Cited

U.S. PATENT DOCUMENTS

| | | | | |
|---|---|---|---|---|
| 3,481,677 | A | 12/1969 | Abrahamson | |
| 4,470,715 | A * | 9/1984 | Reuchlin | A45D 40/264 401/115 |
| 4,797,243 | A * | 1/1989 | Wolbrom | B41K 1/50 264/126 |
| 4,970,854 | A * | 11/1990 | Komiya | B43K 1/12 401/199 |
| 4,976,564 | A * | 12/1990 | Fukuoka | A45D 34/042 401/176 |
| 5,433,545 | A | 7/1995 | Keil | |
| 6,244,774 | B1 | 6/2001 | Barosso et al. | |
| 6,893,181 | B1 * | 5/2005 | Duez | B43K 1/12 156/180 |
| 7,044,675 | B2 * | 5/2006 | Nowak | B43K 5/18 401/225 |
| 7,530,753 | B2 * | 5/2009 | Kobayashi | B43K 7/005 401/194 |
| 8,541,643 | B2 * | 9/2013 | Ring | D06M 15/263 604/368 |
| 9,162,515 | B2 * | 10/2015 | Maruyama | B43K 8/03 |

OTHER PUBLICATIONS

Extended European Search Report dated Jan. 28, 2020 in priority patent application No. 19305982.1, 8 pages.

* cited by examiner

*Primary Examiner* — David P Angwin
*Assistant Examiner* — Bradley S Oliver
(74) *Attorney, Agent, or Firm* — Ohlandt, Greeley, Ruggiero & Perle, LLP

(57) ABSTRACT

A refill for a writing felt pen, the refill comprising a deformable pouch and a nib inserted into the deformable pouch, the deformable pouch comprising a mix of dry absorbent polymer, fibers and dry ink.

18 Claims, 2 Drawing Sheets

REFILL FOR A WRITING FELT PEN

CROSS REFERENCE TO RELATED APPLICATION(S)

This application claims priority to European Application No. EP 19 305 982.1, filed on Jul. 29, 2019, the entire contents of which is incorporated herein by reference.

TECHNICAL FIELD

The present disclosure is related to writing felt pen, and more particularly to a refill for writing felt pen.

BACKGROUND

Refill for writing felt pen are might present problems of ink stability. Moreover, the refills are generally rather voluminous.

SUMMARY

Therefore, according to embodiments of the present disclosure, refill for a writing felt pen is provided. The refill includes a deformable pouch and a nib inserted into the deformable pouch, the deformable pouch including a mix of dry absorbent polymer, fibers and dry ink.

The deformable pouch may comprise a first pouch made of watertight material and a second pouch made of elastic material.

The first pouch may be made of polyethylene (PE), low density polyethylene (PELD), high density polyethylene (PEHD), polypropylene (PP) and/or polyethylene terephthalate (PET).

The second pouch may be made of thermoplastic polymer (TPE), styrene butadiene rubber (SBR), styrene butadiene copolymer (SBC), styrene ethylene/butadiene block copolymer (SEBS), styrene butadiene block copolymer (SBS), nitrile rubber (NBR), butadiene rubber (BR), silicone rubber, polyurethane rubber and/or natural rubber The fibres may comprise or be made of polyethylene, polyester, polyamide or polyacrylonitrile, or mixtures thereof.

The fibres may be fibres having a denier between 1 and 10 den (denier).

The fibres may be continuous fibres having a length greater than 10 cm (centimetre).

The continuous fibres may have a length equal to or smaller than five times the maximum barrel length in which the refill is configured to be inserted.

The fibres may be staple fibres having a length equal to or smaller than 10 cm.

The content of dry absorbent polymer in the mix may be capable of absorbing all the ink when the dry ink is forming a water-based ink.

The dry absorbent polymer may be made of polyacrylamide of potassium, polyacrylamide of sodium, polyacrylate of potassium, polyacrylate of sodium or crosslinked poly (itaconate).

The nib may be a sintered powder nib comprising polypropylene and/or polyethylene.

The nib may include fibres agglomerated by a resin, the fibres being polyester, acrylic, polyamide or polyacrylonitrile and the resin being polyurethane or urea aminoplast.

The nib may be an extruded nib comprising polyacetal, polypropylene or polyethylene.

The deformable pouch may comprise a neck and the nib may be attached by positive locking to the neck.

It is intended that combinations of the above-described elements and those within the specification may be made, except where otherwise contradictory.

According to embodiments of the present disclosure, a barrel for writing felt pen is provided. The barrel includes means for inserting and retaining a refill.

The barrel may be made of two parts that are assembled together to form the barrel.

The deformable pouch may be screwed on the barrel.

The deformable pouch may be press-fitted on the barrel.

The deformable pouch may be snapped on the barrel.

The deformable pouch may be locked on the barrel by a bayonet connexion.

According to embodiments of the present disclosure, a kit is provided. The set includes a refill and a barrel.

According to embodiments of the present disclosure, a method for refilling a writing felt pen is provided. The method includes the steps of:

inserting the refill into the barrel;

dipping the nib into water so as to form a water-based ink and absorb the water-based ink into the dry absorbent polymer.

The method may include a step of removing an empty ink tank from the barrel.

Thanks to the refill including dry ink, the problem of the stability of the ink, for example during storage, is reduced. Moreover, as the refill does not include water, the volume of the refill is smaller than a refill in which the ink is in the hydrated form. Furthermore, the weight of the refill is also smaller than the weight of a refill in which the ink is in the hydrated form.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles thereof.

DETAILED DESCRIPTION

Reference will now be made in detail to exemplary embodiments of the disclosure, examples of which are illustrated in the accompanying drawings. Wherever possible, the same reference numbers will be used throughout the drawings to refer to the same or like parts.

Figure 1:
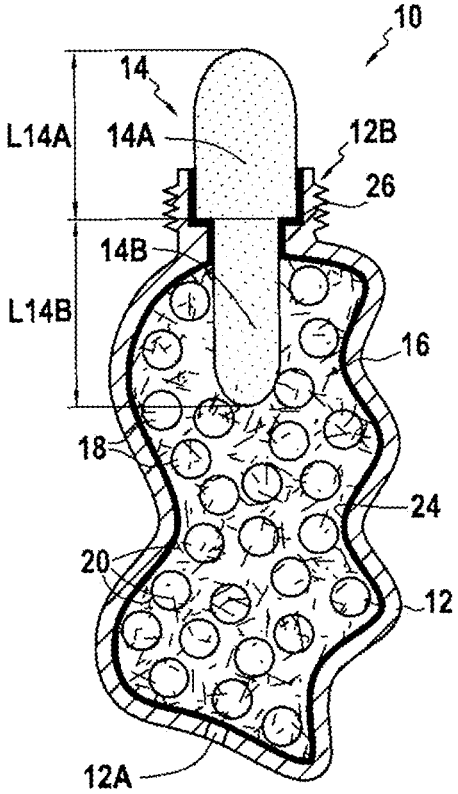
FIG. 1 shows a representation of an exemplary writing felt pen.

FIG. 1 shows a representation of an exemplary writing felt pen 10 according to embodiments of the present disclosure. The writing felt pen 10 may include a barrel 12 and a deformable pouch 24. The writing felt pen 10 may include a nib 14. The nib 14 may be fixed on a neck 26 of the deformable pouch 24, for example by positive locking of the nib 14 in the neck 26 of the deformable pouch 24.

As shown at FIG. 1, the nib 14 may include a writing part 14A, having a length L14A, and partially protruding outside of the deformable pouch 24 and an immersed part 14B, having a length L14B, which is inside the deformable pouch 24. The diameter of the writing part 14A may be larger than the diameter of the immersed part 14B. The nib 14 may present a shoulder present at the transition from the writing part 14A to the immersed part 14B.

Although the deformable pouch 24 is deformable, the neck 26 of the deformable pouch may be rigid enough so as to allow positive locking of the nib 14 into the neck 26. The positive locking may be realized by providing the writing part 14A of the nib 14 with a diameter which is slightly larger than the inner diameter of the neck 26 of the deformable pouch 24.

As shown at FIG. 1, the barrel 12 may include a neck 12B and a ventilation hole 12A. The neck 12B of the barrel 12 may include a screw thread for screwing a cap on the writing felt pen 10.

The neck 12B of the barrel 12 may include beads for snap fitting a cap on the writing felt pen 10.

The deformable pouch 24 may be fixed on the barrel 12 by positive locking of the neck 26 of the pouch 24 to the neck 12*b* of the barrel 12.

The deformable pouch 24 may include a mix 16 of absorbent polymer 18 and fibres 20. An ink is absorbed in the absorbent polymer 18.

Figure 4:
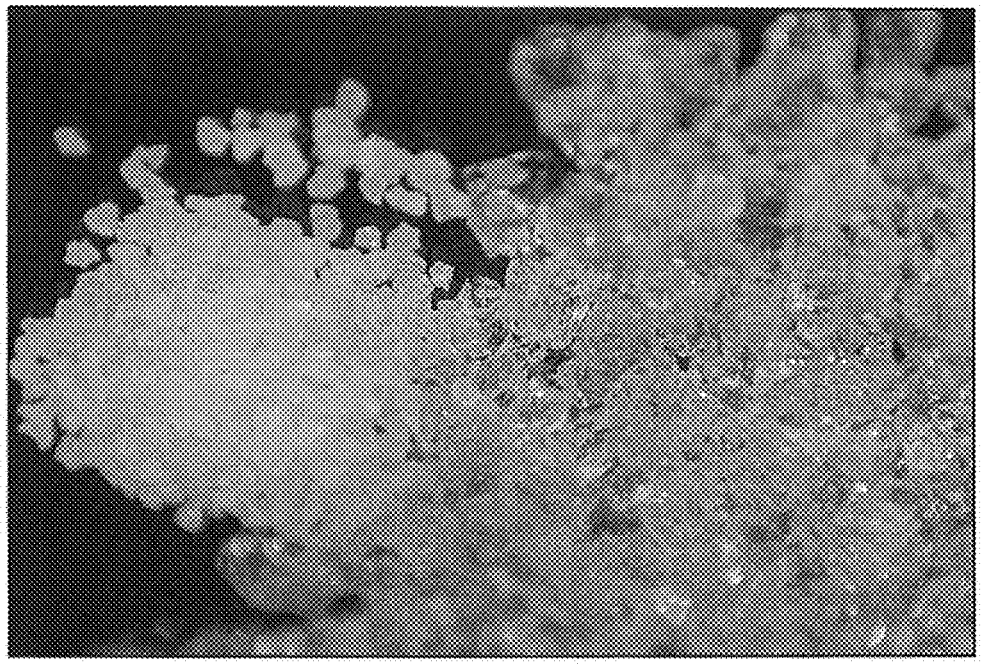
FIG. 4 shows a dry absorbent polymer and the absorbent polymer with absorbed water.
Figure 5:
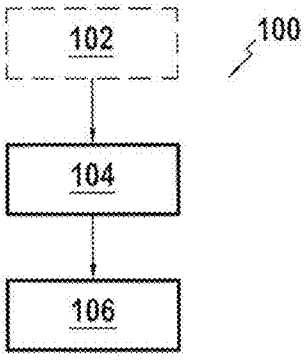
FIG. 5 shows a flow chart of the method according to embodiments of the present disclosure.

The absorbent polymer 18 is schematically represented as balls but it is understood that the shape of the absorbent polymer 18 is not limited to balls. Indeed, in general, the absorbent polymer 18 may have non regular shape both when no ink is absorbed and when ink is absorbed in the absorbent polymer 18, as shown at FIG. 4 without and with water absorbed.

As shown at FIG. 1, the shape of the barrel 12 is not limited to cylindrical shape and the fibres 20 may be staple fibres.

The fibres 20 may be continuous fibres.

As shown at FIG. 1, the nib 14 is in fluidic communication with the mix 16 and the ink absorbed in the absorbent polymer 18 may flow continuously from the absorbent polymer 18 to the nib 14.

In the writing felt pen 10 shown at FIG. 1, it is understood that the barrel 12 may not be deformable, i.e., the barrel may be rigid and/or less deformable than the deformable pouch 24.

Figure 2A:
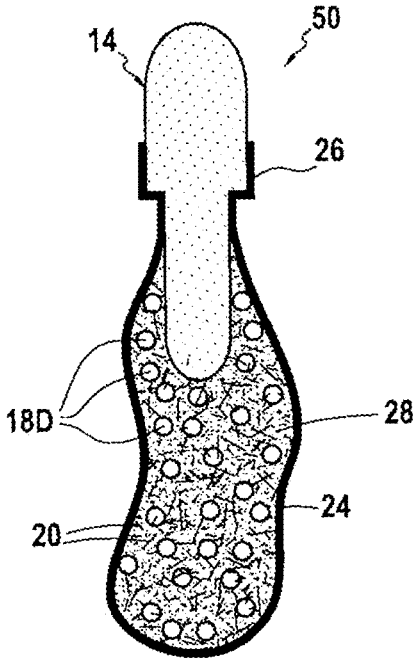
FIG. 2A shows a representation of an exemplary refill according to embodiments of the present disclosure.

FIG. 2A shows a representation of an exemplary refill 50 according to embodiments of the present disclosure. The refill 50 may include the deformable pouch 24 and the nib 14 inserted into the deformable pouch 24. The deformable pouch 24 may include a mix of dry absorbent polymer 18D, fibers 20 and dry ink 28.

Figure 2B:
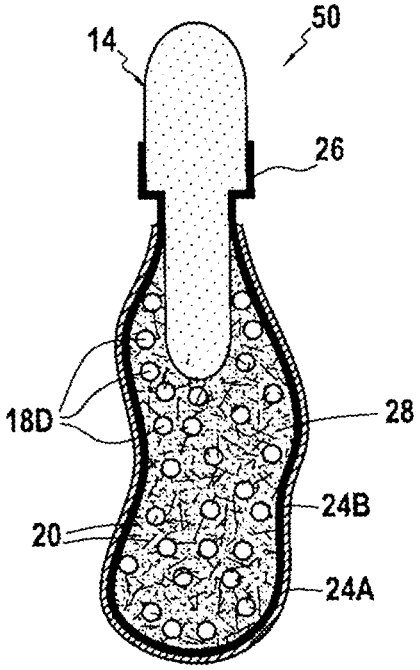
FIG. 2B shows a representation of another exemplary refill according to embodiments of the present disclosure.

FIG. 2B shows a representation of another exemplary refill 50 according to embodiments of the present disclosure. The refill 50 differs in that the deformable pouch 24 comprises a first pouch 24A made of watertight material and a second pouch 24B made of elastic material.

By dry absorbent polymer 18D and dry ink 28, it is understood that the ink is not liquid or in solution and not absorbed by the dry absorbent polymer 18D. Example of dry absorbent polymer 18D is shown at FIG. 4 (left handside).

The fibres 20 may be staple fibres. The fibres 20 may be continuous fibres.

Once the ink in the writing felt pen 10 of FIG. 1 has been used, a method 100 for refilling the writing felt pen 10 may be include a step of removing 102 the empty ink tank from the barrel 12. By empty ink tank, it is understood that the empty ink tank includes the deformable pouch 24, the ink content of the deformable pouch 24 not being enough to allow proper use of the writing felt pen 10.

As a non-limiting example, the barrel 12 may be made of two parts that are assembled together to form the barrel 12. The two parts may be assembled and disassembled so as to open the barrel 12.

The deformable pouch 24 may be screwed on the barrel 12. The deformable pouch 24 may be press-fitted on the barrel 12. The deformable pouch 24 may be snapped on the barrel 12. The deformable pouch 24 may be locked on the barrel 12 by a bayonet connexion.

The method 100 may include a step of inserting 104 the refill 50 into the barrel 12.

Once the refill 50 is inserted and fixed to the barrel 12, the method 100 may include a step of dipping 106 the nib 14, specifically the writing part 14A of the nib 14 into water so as to form a water-based ink and absorb the water-based ink into the dry absorbent polymer.

Figure 3:
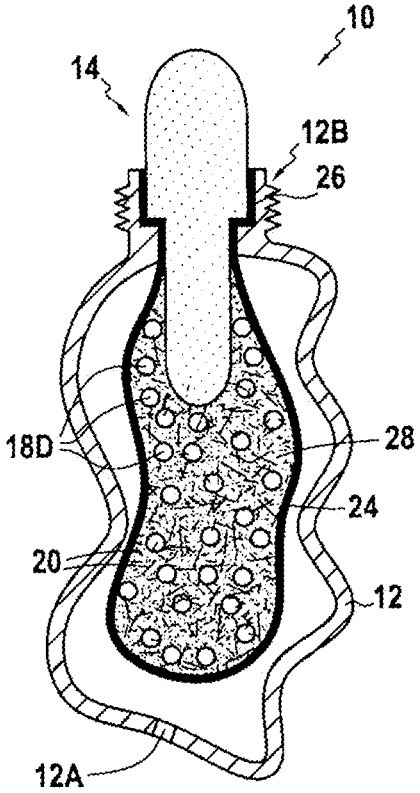
FIG. 3 shows a representation of the exemplary refill of FIG. 2A in a barrel.

FIG. 3 shows a representation of the refill 50 of FIG. 2A fixed to the barrel 12 before carrying out the step of dipping 106 the nib 14. The same applies to the refill 50 of FIG. 2B.

A kit may include one or more barrel 12 and one or more refills 50, for example, the kit may include on refill 50 fixed on the barrel 12 and one or more refills 50.

Thus, when the refill 50 is already fixed to the barrel 12, the step of removing the empty ink tank may not be carried out.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A refill for a writing felt pen, the refill comprising a deformable pouch and a nib inserted into the deformable pouch, the deformable pouch comprising a mix of dry absorbent polymer, fibers and dry ink, wherein the content of dry absorbent polymer in the mix is capable of absorbing all the ink once the dry ink is forming a water-based ink.

2. The refill according to claim 1, wherein the fibres comprise or are made of polyethylene, polyester, polyamide or polyacrylonitrile, or mixtures thereof.

3. The refill according to claim 1, wherein the fibres are fibres having a denier between 1 and 10 den.

4. The refill according to claim 1, wherein the fibres are continuous fibres having a length greater than 10 cm.

5. The refill according to claim 4, wherein the continuous fibres have a length equal to or smaller than five times the maximum barrel length in which the refill is configured to be inserted.

6. The refill according to claim 1, wherein the fibres are staple fibres having a length equal to or smaller than 10 cm.

7. The refill according to claim 1, wherein the dry absorbent polymer is made of polyacrylamide of potassium, polyacrylamide of sodium, polyacrylate of potassium, polyacrylate of sodium or crosslinked poly(itaconate).

8. The refill according to claim 1, wherein the nib is a sintered powder nib comprising polypropylene and/or polyethylene.

9. The refill according to claim 1, wherein the nib comprises fibres agglomerated by a resin, the fibres being polyester, acrylic, polyamide or polyacrylonitrile and the resin being polyurethane or urea aminoplast.

10. The refill according to claim 1, wherein the nib is an extruded nib comprising polyacetal, polypropylene or polyethylene.

11. The refill according to claim 1, wherein the deformable pouch comprises a neck and the nib is attached by positive locking to the neck.

12. The refill according to claim 1, wherein the deformable pouch comprises a first pouch made of watertight material and a second pouch made of elastic material.

13. A barrel for writing felt pen, the barrel comprising means for inserting and retaining a refill according to claim 1.

14. A method for refilling a writing felt pen, the method comprising the steps of:

inserting a refill into a barrel, the refill comprising a deformable pouch and a nib inserted into the deformable pouch, the deformable pouch comprising a mix of dry absorbent polymer, fibers and dry ink; and dipping the nib into water so as to form a water-based ink and absorb the water-based ink into the dry absorbent polymer, wherein the content of dry absorbent polymer in the mix is capable of absorbing all the ink once the dry ink is forming a water-based ink.

15. The method according to claim 14, comprising a step of removing an empty ink tank from the barrel.

16. The method according to claim 14, wherein the fibres comprise or are made of polyethylene, polyester, polyamide or polyacrylonitrile, or mixtures thereof.

17. The method according to claim 14, wherein the dry absorbent polymer is made of polyacrylamide of potassium, polyacrylamide of sodium, polyacrylate of potassium, polyacrylate of sodium or crosslinked poly(itaconate).

18. The method according to claim 14, wherein the deformable pouch comprises a first pouch made of watertight material and a second pouch made of elastic material.

* * * * *